US009833682B1

(12) United States Patent
Morgan et al.

(10) Patent No.: US 9,833,682 B1
(45) Date of Patent: Dec. 5, 2017

(54) WEIGHT LIFTING DROP BAG

(71) Applicants: John E. Morgan, Heyworth, IL (US); Pamela S. Morrow, Mount Pulaski, IL (US)

(72) Inventors: John E. Morgan, Heyworth, IL (US); Pamela S. Morrow, Mount Pulaski, IL (US)

(73) Assignee: John E. Morgan, Heyworth, IL (US)

( * ) Notice: Subject to any disclaimer, the term of this patent is extended or adjusted under 35 U.S.C. 154(b) by 0 days.

(21) Appl. No.: 15/071,262

(22) Filed: Mar. 16, 2016

Related U.S. Application Data

(63) Continuation-in-part of application No. 14/451,476, filed on Aug. 5, 2014, now abandoned.

(60) Provisional application No. 61/862,548, filed on Aug. 6, 2013.

(51) Int. Cl.
*A63B 21/072* (2006.01)
*A63B 71/00* (2006.01)

(52) U.S. Cl.
CPC ..... *A63B 71/00* (2013.01); *A63B 21/072* (2013.01)

(58) Field of Classification Search
CPC . A63B 71/00; A63B 71/0054; A63B 71/0063; A63B 71/0081; A63B 6/00; A63B 6/02; A63B 21/4037; A63B 21/072; E04F 15/02177; E04F 15/105; E04F 15/107; E04F 15/02038; E04F 15/02172; E04F 2201/091; E04F 2290/044; E04F 2290/095; Y10T 428/24868; Y10T 428/24355; Y10T 428/269; Y10T 428/31917
See application file for complete search history.

(56) References Cited

U.S. PATENT DOCUMENTS

| | | | | |
|---|---|---|---|---|
| 3,480,280 | A | 11/1969 | Gamertsfelder | |
| 4,137,348 | A | 1/1979 | Gilman | |
| 5,079,786 | A * | 1/1992 | Rojas | A47C 7/021 5/654 |
| 5,916,672 | A * | 6/1999 | Reeves | B32B 5/18 428/316.6 |
| 7,943,213 | B2 | 5/2011 | Weber | |
| 8,287,437 | B1 * | 10/2012 | Rovere | A63B 69/004 473/444 |
| 8,444,531 | B1 | 5/2013 | Johnson et al. | |
| 8,959,683 | B2 * | 2/2015 | Rochlin | A47G 9/10 5/490 |
| 2012/0036698 | A1 * | 2/2012 | Guertin | A63B 63/004 29/428 |

(Continued)

OTHER PUBLICATIONS

Flooring Tips for Garage Gyms Published date: Jun. 7, 2013 Retrieved date: Oct. 21, 2015 Website: http://sealgrinderpt.com/navy-seal-workout/flooring-tips-for-garage-gyms.html/.*

(Continued)

*Primary Examiner* — Loan H Thanh
*Assistant Examiner* — Megan Anderson
(74) *Attorney, Agent, or Firm* — Philip L. Bateman

(57) ABSTRACT

Dropping a weight onto a weight lifting drop bag allows a weight lifter to drop a weight onto a floor with minimal damage to the floor, with minimal noise, and without any bouncing of the weight. The bag is a flexible enclosure filled with resilient pellets. The bag has a generally flat or slightly concave upper surface, a length of about two to eight feet, a width of about one and one-half to four feet, and a height of about two to twelve inches.

12 Claims, 2 Drawing Sheets

(56) References Cited

U.S. PATENT DOCUMENTS

| | | | | |
|---|---|---|---|---|
| 2013/0043627 | A1* | 2/2013 | Chu | A63B 6/00 267/141 |
| 2013/0086744 | A1* | 4/2013 | Silverman | A63B 6/00 5/420 |

OTHER PUBLICATIONS

SKLZ Smash Bag golf trainer; retrieved:Jun. 11, 2014; website: www.sklz.com.*

* cited by examiner

WEIGHT LIFTING DROP BAG

CROSS-REFERENCE TO RELATED APPLICATIONS

This application is a continuation in part of U.S. application Ser. No. 14/451,476, Aug. 5, 2014, now pending, that claims the benefit of U.S. Provisional Application Ser. No. 61/862,548, Aug. 6, 2013.

FIELD OF THE INVENTION

This invention relates to weight lifting. More particularly, this invention relates to weight lifting accessories.

BACKGROUND OF THE INVENTION

Weight lifting is a physical activity in which a person lifts a barbell, dumbbell, or other weight one or more times. The primary goal of weight lifting is to strengthen and increase the size of the skeletal muscles. Weight lifting (also known as weight training) is practiced by millions of people worldwide for general fitness. Weight lifting also includes the sports of bodybuilding (in which contestants compete to have the most muscular and attractive bodies), powerlifting (in which contestants compete to lift the most weight in the bench press, squat, and dead lift), and weightlifting (an Olympic sport in which contestants compete to lift the most weight in the snatch and the clean and jerk).

Muscle development is maximized during weight lifting by repeating the lift until muscle failure occurs (when another repetition cannot be performed). When failure occurs while performing a lift (whether standing, sitting, or lying down), the lifter must set the weight back down upon the floor. Overall fatigue makes it difficult to lean over to set a weight down gently upon the floor after failure. For example, it is especially difficult to set dumbbells down when lying on a bench performing dumbbell presses. As a result, weight lifters must sometimes drop the weight upon the floor at the end of a set. Some weight lifters also drop weights to draw attention to themselves.

Dropping a weight upon a floor is damaging to the floor and creates noise that is distracting and upsetting to others. To reduce damage and noise, many gyms have floors that are covered with a resilient surface. For example, a resilient surface composed of sheets of material is disclosed in Gilman, U.S. Pat. No. 4,137,348, Jan. 30, 1979; and a resilient surface composed of foam pieces of varying size is disclosed in Chu, U.S. Pat. Appln. Publn. No. 2013/0043627, Feb. 21, 2013. Unfortunately, resilient surfaces create their own problems. In particular, dropping a weight on a resilient surface is dangerous because the weight can bounce off the floor and injure bystanders. Many gyms have rules against dropping weights, but enforcement is difficult and many lifters continue to drop the weights.

Various products have been disclosed that contain resilient pellets. For example, Gamertsfelder, U.S. Pat. No. 3,480,280, Nov. 25, 1969, discloses a bean bag game projectile filled with resilient rubber pellets, and Weber, U.S. Pat. No. 7,943,213, May 17, 2011, discloses an artificial athletic field surface having the structure of a giant, flat bean bag. These products are not sized, shaped, or suited for use with weight lifting.

A golf training aid consisting of an impact bag to be hit by the golf club is sold as the SKLZ SMASH BAG golf trainer by Pro Performance Sports of Carlsbad, Calif. on its website www.sklz.com. The bag contains a zipper and is filled with towels or clothes by the user. The bag is not sized, shaped, or suited for use with weight lifting.

Accordingly, there is a demand for a weight lifting accessory and a weight lifting method that allows a weight lifter to drop a weight with minimal damage to the floor, with minimal noise, and without any bouncing of the weight.

SUMMARY OF THE INVENTION

The general objects of this invention are to provide an improved weight lifting accessory and an improved weight lifting method.

We have invented a weight lifting drop bag. The bag comprises a flexible enclosure filled with a plurality of resilient members having varying densities, the bag having a generally flat or slightly concave upper surface, a length of about two to eight feet, a width of about one and one-half to four feet, and a height of about two to twelve inches.

We have also invented a method of weight lifting. The method comprises (a) obtaining a weight lifting drop bag comprising a flexible enclosure filled with a plurality of resilient members having varying densities, the bag having a generally flat or slightly concave upper surface, a length of about two to eight feet, a width of about one and one-half to four feet, and a height of about two to twelve inches; (b) setting the bag on a floor; (c) performing a lift using a weight, the weight consisting of a barbell, dumbbell, or other weight, in close proximity to the bag; and (d) dropping the weight onto the bag.

The weight lifting drop bag of this invention, and the method of using it, allows a weight lifter to drop a weight with minimal damage to the floor, with minimal noise, and without any bouncing of the weight.

DETAILED DESCRIPTION OF THE INVENTION

1. The Invention in General

Figure 1:
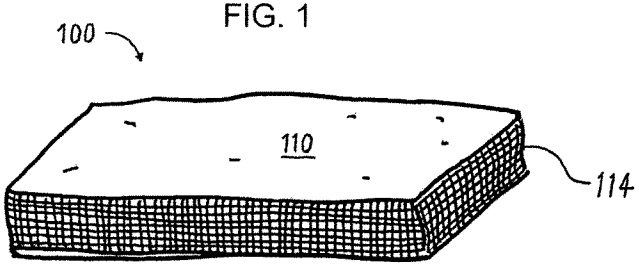
FIG. 1 is a perspective view of a first embodiment of the weight lifting drop bag of this invention.
Figure 2:
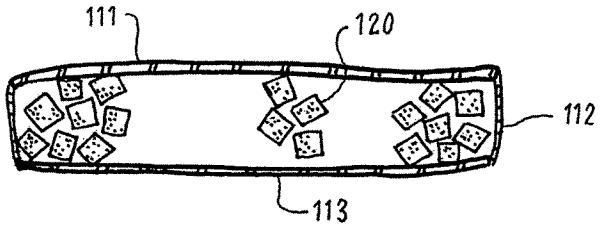
FIG. 2 is a partial sectional view thereof.
Figure 3:
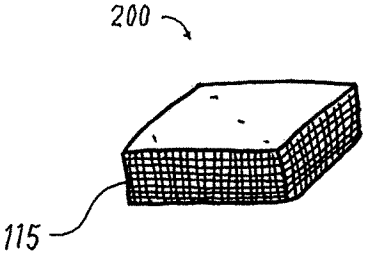
FIG. 3 is a perspective view of a second embodiment of the weight lifting drop bag of this invention.
Figure 4:
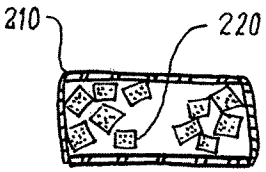
FIG. 4 is a partial sectional view thereof.

This invention is best understood by reference to the drawings. Referring to FIGS. 1 and 2, a first embodiment of the weight lifting drop bag 100 of this invention comprises an enclosure 110 having a top 111, a side 112, and a bottom 113. The enclosure is filled with resilient members 120. Referring to FIGS. 3 and 4, a second embodiment of the weight lifting bag 200 also comprises an enclosure 210 filled with resilient members 220. The first and second embodiments differ primarily in size and shape. The first embodiment is especially suited for use with barbells while the second embodiment is especially suited for use with dumbbells.

2. The Enclosure

The weight lifting drop bag has a size and shape to accommodate a dropped weight. The height (depth) of the bag is generally about two to twelve inches and is preferably about three to six inches. If the height decreases below about two inches, the cushioning decreases and the chances of the weight bouncing or bottoming out on the floor increases. If the height increases above about twelve inches, the weight and bulkiness make the bag an obstacle for others and cumbersome to move. The possibility also increases that the lifter may not have clearance over the bag to drop the weight.

The preferred length and width of the bag depend on the dimensions of the weight that is to be accommodated. For example, bags having a length longer than their width (as shown in FIGS. 1 and 2) are preferred to accommodate a dropped barbell. Such shapes include rectangles and elongated ovals (when viewed from above) having a length of about five to eight feet and a width of about one and one-half to four feet. Bags having an approximately equal length and width (as shown in FIGS. 3 and 4) are preferred to accommodate a dropped dumbbell. Such shapes include squares and circles (when viewed from above) having both a length and width of about one and one-half to four feet. An especially preferred bag for dumbbells has a length of about 28 to 36 inches and a width of about 20 to 28 inches. As with height, excessive lengths and widths make the bag an obstacle for others and cumbersome to move.

The upper surface of the bag is generally flat or slightly concave to accommodate a dropped weight and to reduce the possibility of the weight falling off the bag.

The enclosure of the bag is made of a durable, flexible sheet material. Suitable materials include thermoplastics and fabrics. An especially preferred thermoplastic is a coated polyvinyl chloride (PVC) having a weight of about 20 ounces per square yard and a denier of about 1,000. This material has excellent tensile strength, excellent tear strength, and is easily cleaned. Fabrics such as denim and canvas have good strengths, but tend to be more difficult to clean. The optimal material for the enclosure is a matter of choice that depends on durability, cost, appearance, and ease of cleaning.

The enclosure has at least one air vent 114 that allows air to enter and leave the interior of the enclosure, but prevents the resilient members from leaving. The presence of at least one air vent greatly reduces the possibility of damage to the enclosure's seams due to rapid air expansion when a weight is dropped. The enclosure preferably has side walls 115 made completely of mesh as shown in FIGS. 1 to 4. An especially preferred mesh is a dip coated interlocking grid weave scrim mesh having a weight of about 8 ounces per square yard and a denier of about 1,000.

3. The Resilient Members

The bag is filled with a plurality of resilient members. The members have a nominal size of about one-half to three inches, preferably about two inches. Members smaller than about one-half inch are undesirable because they are prone to clumping and members larger than about three inches are undesirable because they provide less uniformity to the cushioning. The shape of members is a matter of choice and cubes, spheres, and random shapes are suitable. Members are preferably in the shape of cubes because of performance, durability, and cost.

The resilient members are of varying densities. It was surprisingly discovered that resilient members of a single density are unable to provide the combination of cushioning and support required for optimal performance. In the preferred embodiment, resilient members of two different densities are used. About one-half of the members by volume are of relatively low density to provide the desired cushioning (to prevent bouncing) and about one-half of the members are of relatively high density to provide the desired support (to prevent the weight from bottoming out).

The low density resilient members provide the necessary cushioning. The low density members are generally made of open cell foams having a density less than about 4 pounds per cubic foot. The low density members are preferably made of open cell polyurethane foams with a density of about 2 pounds per cubic foot with a minimum resiliency percentage of 20 percent.

The high density resilient members provide the necessary support. The high density members are generally made of closed cell foams having a density greater than about 5 pounds per cubic foot. The high density members are preferably made of closed cell nitrile butadiene rubber (NBR) and polyvinyl chloride (PVC) foams with a density of about 7 pounds per cubic foot, a Shore 00 value of about 55, and a compression deflection value of about 6 pounds per square inch.

4. Uses and Advantages

Figure 7:
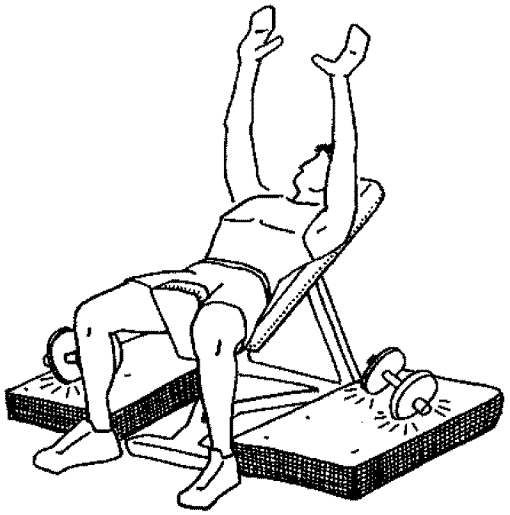
FIG. 7 is a perspective view of a weight lifter completing an inclined dumbbell press on a bench by dropping the dumbbells onto a weight lifting drop bag on each side of the bench.
Figure 6:
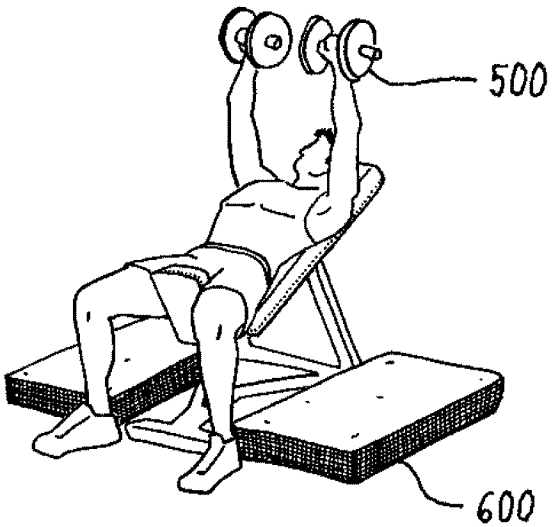
FIG. 6 is a perspective view of a weight lifter performing a second part of an inclined dumbbell press on a bench with a weight lifting drop bag on each side of the bench.
Figure 5:
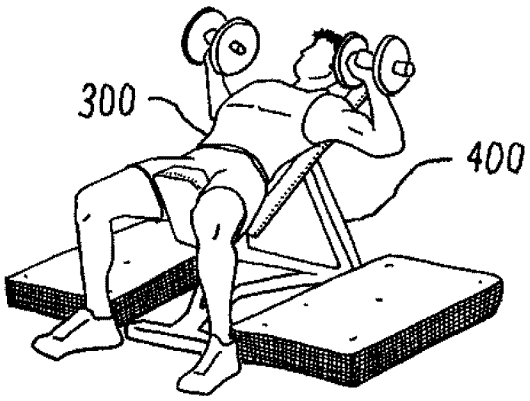
FIG. 5 is a perspective view of a weight lifter performing a first part of an inclined dumbbell press on a bench with a weight lifting drop bag on each side of the bench.

The use of the weight lifting drop bag can now be considered. Referring to FIGS. 5 to 7, a weight lifter 300 is shown performing an inclined press on a bench 400 with two dumbbells 500. Two weight lifting drop bags 600 are on the floor on either side of the bench. The weight lifting drop bags can be in close proximity before the lifting is begun or they can be moved into position after the lift is begun, either by the lifter or by a second person. After the lifter has completed lifting, he simply lets go of (releases) the dumbbells and allows them to drop onto the bags. The bags cushion the fall of the dumbbells without damage to the floor, with minimal noise, and without risk of the weight bouncing off the floor. A single bag is typically used when performing a lift with a barbell or a single dumbbell. Two bags are typically used when performing a lift with a pair of dumbbells.

The weight lifting drop bag is relatively light in weight, is easily moved about a gym, and is easily stacked for storage when not in use. The bag is colored as desired for aesthetics and visibility.

The weight lifting drop bag of this invention, and the method of using it, allow a weight lifter to drop a weight onto a floor with minimal damage to the floor, with minimal noise, and without any bouncing of the weight. The gym owner, the weight lifter, and others at the gym all benefit from use of the bag. The gym owner benefits by the reduced damage to the floor. The weight lifter benefits by being able to lift to failure without the need to set the weights down gently. And other people at the gym benefit from the reduced noise and the elimination of the danger of bouncing weights.

5. Example

This example illustrates the effect of resilient member composition on the ability of a drop bag to absorb the impact of a dropped weight.

A variety of resilient materials were obtained from different sources. The resilient materials were designated by the letters "A" through "E" and are described below:

Foam A. An open cell polyurethane foam.

Foam B. A closed cell nitrile butadiene rubber (NBR) and polyvinyl chloride (PVC) blend foam.

Foam C. A closed cell polyethylene (PE) foam.

Foam D. An expanded polystyrene (EPS) foam.

Foam E. A recycled denim rebounded foam.

The above resilient materials were tested in densities of about one to eight pounds per cubic foot and in various shapes, including sheet products, small pellets, cubes, and spheres. The above resilient materials were tested by themselves and in combination with other materials. The materials were placed inside a rectangular enclosure having dimensions of 32 by 24 by 4 inches and having two mesh side walls. A 100 pound weight was then dropped from a height of four feet and observed. Foam A and Foam B were found to be the preferred materials. The results of these preferred materials at varying percentages are shown in Table 1. The percentages are based on volume.

TABLE 1

Effect of Resilient Member Composition

| Composition | Observations |
|---|---|
| 100% A, 2 lbs/ft$^3$, 2 inch cubes | Weight bottomed out |
| 100% B, 7 lbs/ft$^3$, 2 inch cubes | Excessive bouncing |
| 75% A, 25% B, as described above | Weight sunk too deeply |
| 25% A, 75% B, as described above | Some bouncing |
| 50% A, 50% B, as described above | Optimal |

The results show that a mixture of 50% polyurethane foam with a density of two pounds per cubic foot in two inch cubes and 50% closed cell nitrile butadiene rubber and polyvinyl chloride blend foam with a density of seven pounds in two inch cubes provided the optimal combination of cushioning and bounce reduction.

We claim:

1. A weight lifting drop bag comprising a flexible enclosure filled with a plurality of resilient members wherein half of the plurality of resilient members have a density less than four pounds per cubic foot and half of the plurality of resilient members have a density greater than five pounds per cubic foot, the bag having a generally flat or slightly concave upper surface, a length of two to eight feet, a width of one and one-half to four feet, and a height of two to twelve inches.

2. The weight lifting drop bag of claim 1 wherein the plurality of resilient members in the bag are cubes that have a side length of one to three inches.

3. The weight lifting drop bag of claim 1 wherein the flexible enclosure contains an air vent.

4. The weight lifting drop bag of claim 1 wherein the plurality of resilient members are made of foam.

5. The weight lifting drop bag of claim 1 wherein the plurality of resilient members are cubes with a side length of two inches.

6. The weight lifting drop bag of claim 1 wherein the flexible enclosure has a mesh side wall.

7. A method of weight lifting comprising:

(a) obtaining a weight lifting drop bag comprising a flexible enclosure filled with a plurality of resilient members wherein half of the plurality of resilient members have a density less than four pounds per cubic foot and half of the plurality of resilient members have a density greater than five pounds per cubic foot, the bag having a generally flat or slightly concave upper surface, a length of two to eight feet, a width of one and one-half to four feet, and a height of two to twelve inches;

(b) setting the bag on a floor;

(c) performing a lift using a weight, the weight consisting of a barbell, dumbbell, or other weight, in close proximity to the bag; and (d) dropping the weight onto the bag.

8. The method of claim 7 wherein the plurality of resilient members in the bag have a side length of one to three inches.

9. The method of claim 7 wherein the flexible enclosure of the bag contains an air vent.

10. The method of claim 7 wherein the plurality of resilient members in the bag are made of foam.

11. The method of claim 7 wherein the plurality of resilient members in the bag are cubes with a side length of two inches.

12. The method of claim 7 wherein the flexible enclosure of the bag has a mesh side wall.

* * * * *